US009060612B2

(12) United States Patent
Lee

(10) Patent No.: US 9,060,612 B2
(45) Date of Patent: Jun. 23, 2015

(54) BALANCE CHAIR

(76) Inventor: Rebecca M. Lee, Colorado Springs, CO (US)

( * ) Notice: Subject to any disclaimer, the term of this patent is extended or adjusted under 35 U.S.C. 154(b) by 287 days.

(21) Appl. No.: 13/473,830

(22) Filed: May 17, 2012

(65) Prior Publication Data

US 2012/0292968 A1 Nov. 22, 2012

Related U.S. Application Data

(60) Provisional application No. 61/486,873, filed on May 17, 2011.

(51) Int. Cl.

| | |
|---|---|
| ***A47C 3/025*** | (2006.01) |
| ***A47C 7/14*** | (2006.01) |
| ***A47C 7/42*** | (2006.01) |
| ***A47C 7/54*** | (2006.01) |
| ***A47C 9/00*** | (2006.01) |

(52) U.S. Cl.

CPC ..... *A47C 3/0252* (2013.01); *A47C 3/025* (2013.01); *A47C 7/14* (2013.01); *A47C 7/42* (2013.01); *A47C 7/546* (2013.01); *A47C 9/002* (2013.01)

(58) Field of Classification Search

CPC ..... A47C 3/0252

USPC ..... 297/264.1, 265.1, 266.1, 267.1, 302.1, 297/314; 248/603–605, 622

See application file for complete search history.

(56) References Cited

U.S. PATENT DOCUMENTS

| | | | | | |
|---|---|---|---|---|---|
| 354,042 | A | * | 12/1886 | Connolly | 297/266.1 |
| 1,961,530 | A | * | 6/1934 | Spanenberg | 297/314 |
| 2,048,148 | A | * | 7/1936 | Stoll | 248/583 |
| 2,132,291 | A | | 10/1938 | Fitos | |
| 2,681,686 | A | * | 6/1954 | Sheron | 248/582 |
| 2,707,986 | A | | 5/1955 | Johnson | |
| 2,719,751 | A | | 10/1955 | Taylor | |
| 4,807,841 | A | | 2/1989 | Edstrom | |
| 4,974,904 | A | * | 12/1990 | Phillips et al. | 297/258.1 |
| 5,044,587 | A | * | 9/1991 | Degen | 248/158 |
| 5,397,295 | A | | 3/1995 | van Deursen | |
| 5,573,304 | A | * | 11/1996 | Glockl | 297/314 |
| 5,590,930 | A | | 1/1997 | Glockl | |
| 5,728,049 | A | | 3/1998 | Alberts | |
| 5,810,751 | A | | 9/1998 | Meier et al. | |
| 6,176,548 | B1 | * | 1/2001 | Thole et al. | 297/302.1 |
| 6,481,795 | B1 | | 11/2002 | Pettibon | |
| 6,685,268 | B2 | * | 2/2004 | Meyer | 297/313 |
| 6,688,689 | B1 | | 2/2004 | Thorn | |
| 7,100,983 | B1 | | 9/2006 | Gant | |
| 7,686,396 | B2 | | 3/2010 | Schaaf | |
| 7,766,426 | B2 | | 8/2010 | Meidan | |
| 8,075,056 | B2 | | 12/2011 | Glockl | |

(Continued)

*Primary Examiner* — Peter Brown

(57) ABSTRACT

A balance chair includes a central vertical post with a base attached at a lower end of the central post; a flexible joint attached at an upper end of the central post, a seat attached atop the flexible joint; and a plurality of resistance members attached to the central post and the seat, wherein the plurality of resistance members are arranged around the post in a spaced-apart manner, wherein the flexible joint supports the seat and enables the seat to pivot about an effective pivot point as defined by the shape and composition of the flexible joint, and wherein the resistance members resist but do not prevent pivoting of the seat about the effective pivot point. The flexible joint and the resistance members support pivoting of the seat both side-to-side and fore-and aft and any combination thereof. The resistance members limit a degree of pivoting of the seat.

17 Claims, 10 Drawing Sheets

(56) References Cited

U.S. PATENT DOCUMENTS

| | | | | |
|---|---|---|---|---|
| 8,540,314 | B2 * | 9/2013 | Fernandez | 297/314 |
| 2002/0043846 | A1 | 4/2002 | Brauning | |
| 2008/0191525 | A1 | 8/2008 | Jensen et al. | |
| 2009/0188410 | A1 | 7/2009 | Billich | |
| 2009/0261641 | A1 | 10/2009 | Dickie | |
| 2009/0261642 | A1 | 10/2009 | Diskie | |

* cited by examiner

BALANCE CHAIR

RELATED APPLICATIONS

This application claims priority of the U.S. provisional application 61/486,873 which was filed on 17 May 2011, and which is fully incorporated herewith by reference.

FIELD OF INVENTION

This invention relates to chairs, and in particular to a balance chair having a seat which is connected to a base by a gimballing joint and a plurality of resistance members.

BACKGROUND OF THE INVENTION

Many have sought to realize the benefits of movable platform seating, including decreased stiffness and injury. Decades of patents show that inventors have been attempting to design a chair which will bring the healthful benefits of dynamic seating to the public. If market success is the measure, no one has yet succeeded.

In a 'normal' seating arrangement the chair is mostly stationary and the body rests upon it. In most movable platform seats, this relationship remains largely the same: though the platform is movable, the relationship between body and chair is still one of a user of infinite variety (in size, strength and desired characteristic of movement), and a standardized chair (with a little adjustability).

SUMMARY OF INVENTION

The current invention relates to a balance chair which addresses the many shortcomings of other designs described above. Numerous variations are described below, and virtually all variations may be used interchangeably as alternative arrangements, or the numerous variations may be combined with each other to provide the desired chair performance. That is any flexible joint may be combined with any resistance members as well as any other selected components to achieve a desired chair performance. In contrast to prior art arrangements, the balance chair and the user's body become one mechanical system.

A key to realizing this unified mechanical system of user and chair is balance. Many chairs have been designed to enable motion, but key to an integrated, and less tiring seating system, is not only the possibility of motion, but also the requirement that stasis come only through balance. In other words, the chair must always engage the user; that the user remains upright by the use of one's muscles, not by the utilization of a hard stop mechanism in the chair itself. According to one arrangement, the current design accomplishes the goal of the balance-requiring chair via the combination of an omni-directional polymer joint coupled with progressive resistance provided by an elastomer sheet spring.

A key to users of various sizes and strengths becoming a single mechanical system with this chair is a movable platform that provides variable resistance as the user moves (or shifts his center of gravity) off-center, and variable and progressive resistance as one reaches the outer limits of balance. Adjustable resistance in the movement of the omni directional joint is important, as is variable and progressive resistance in the elastomer (or other material) which serves to restrain motion as one nears the limits of balance. In this way, different heights, leg lengths (lever arms), and core strengths will be able to be matched or accommodated by the chair. The chair will both adequately engage and free each user from the rigid constraints of prior art chairs.

According to a first aspect of the invention, a balance chair includes a central vertical post with a base attached at a lower end of the central post; a flexible joint attached at an upper end of the central post a seat attached atop the flexible joint, and a plurality of resistance members attached to the central post and the seat, wherein the plurality of resistance members are arranged around the post in a spaced-apart manner, wherein the flexible joint supports the seat and enables the seat to pivot about an effective pivot point that varies in its precise location as defined by the shape and composition of the flexible joint, and may include some lateral translation movement, and wherein the resistance members resist but do not prevent pivoting of the seat about the effective pivot point. The effective pivot point may be relatively fixed, such as where a ball joint is used as the flexible joint, or it may exhibit some shifting characteristics, such as where another type of flexible joint is used, e.g. elastomer joint or spring joint. The shifting characteristics may include a degree off translational movement which is necessary, to a degree, to enable the necessary degree of movement. However, an excessive amount of translational movement, e.g. more than that required for proper operation of the chair, is undesirable and may lead to excessive or premature wear of the chair.

According to a second aspect of the invention, a balance chair includes a central vertical post with a base attached at a lower end of the central post; a flexible joint attached at an upper end of the central post; a seat attached atop the flexible joint; and a collar attached around, the flexible joint, wherein the flexible joint supports the seat and enables the seat to pivot omni-directionally about an effective pivot point defined by the flexible joint, and wherein the collar resists but does not prevent pivoting of the seat about the effective pivot point, and wherein the collar resists translational movement of the flexible joint.

According to a third aspect of the invention, a balance chair includes a central vertical post with a base attached at a lower end of the central post; a flexible joint attached at an upper end of the central post; a seat attached atop the flexible joint; a collar attached around the flexible joint; and a plurality of resistance members attached to the central post and the seat, wherein the plurality of resistance members are arranged around the post in a spaced-apart manner, wherein the flexible joint supports the seat and enables the seat to pivot omni-directionally about a effective pivot point defined by the flexible joint, and wherein the resistance members resist but do not prevent pivoting of the seat about the effective pivot point, and wherein the collar resists but does not prevent pivoting of the seat about the effective pivot point, and wherein the collar resists translational movement of the flexible joint. The collar may affect the quickness of the shift off-center. The collar resists the initial movement and does not simply bolster the joint against excessive translation.

In a first variation, the flexible joint, the collar, and the resistance members each separately support the pivoting of the seat omni-directionally, both side-to-side and fore- and aft and any combination thereof. This arrangement ensures that the chair is not simply a rocking chair, but requires the user to exercise the entire core of his/her body for maximum benefit and reduced fatigue.

In a further variation, the collar is in direct supporting contact with the flexible joint. The collar provides assistance to the flexible joint, such as an elastomeric joint, e.g., windsurfer mast joint, or a spring joint, especially where such flexible joints may exhibit translational movement or partially- or fully-collapse under a vertical load. The translational movement is identified by a shifting of some or all of the material of the flexible joint laterally, e.g. to one side or another. Such translational movement reduces the ability of the flexible joint to provide supported omni-directional movement and tilting of the seat, and may act to reduce the life of the flexible joint. The collar may be fully integrated into the flexible joint, e.g. unitary molded construction, or the collar may be a distinct element which is attached around the flexible joint. In other embodiments, the collar may be adjustable, e.g. pneumatically, hydraulically or mechanically, and it may be attached in direct contact with the flexible joint or with a defined, finite spacing between the collar and the flexible joint.

In another variation, the resistance members limit a degree of pivoting of the seat. A limitless, or effectively limitless, pivoting action may not provide the optimum benefit to the user, and may be impractical for daily use. However, a limited degree of pivoting, such as about 30 degrees in each direction permits the user's core, legs and hips to be sufficiently engaged without exaggerated risks. The degree of pivoting may be limited by the resistance members or by another arrangement, such as a mechanical limiter, attached to the seat, the center post or the flexible joint, or some combination of two or more of these elements. The limiter may provide a hard, abrupt stopping point or a gradually-increasing resistance.

In another variation, the resister is molded polymer cup, which may be a single-piece unit attached between the post and the seat.

In a further variation, an adjustment mount is attached to the central post, wherein resistance of the resistance members is adjustable according to placement of the adjustment mount. The adjustment mount may be adjustably attached to the central post by any number of known arrangements, such as a friction clamp or the adjustment mount may be a threaded collar which engages a corresponding threaded central post. Generally speaking, moving the adjustment mount higher or lower on the central post will adjust the tension or compression of the resistance members, depending on the construction of the resistance members, and thereby adjust the resistance of the seat to pivot. This will permit a user to adjust the seat according to his/her core strength, the environment in which the chair will be used, and the desired resistance to pivoting.

In another variation, the flexible joint is an elastomer joint. An elastomer joint, such as used in windsurfing to provide a flexible connection between the board and the mast, provides a large range of motion and some cushioning effect at the same time, and further provides some translational motion, which is similar to human musculoskeletal movement.

In a further variation, the flexible joint is a ball joint. A ball joint provides an advantage in that a more-definite pivot point is provided, and depending on the types of materials used to make the ball joint, the degree of friction or resistance to movement of the ball joint (and the seat) may be closely controlled/defined. Various metals, polymers and woods may be selected for the ball joint.

In another variation, the flexible joint is a spring. A spring, such as a coil spring or a leaf spring arrangement provides the advantages of freedom-of-movement of the seat with respect to the central post, but also provides a tendency to resist pivoting of the seat. These attributes may be selectively combined with various resistance members to achieve the desired seat performance.

In a further variation, the resistance members are made of a polymer compound. Various polymer compounds, such as rubbers and plastics may be selected based on their resistance, such as their resistance to stretching, under tension. A polymer compound resister provides the advantage of non-linear resistance. Varying the thickness and/or the type of polymer may be used to control the degree of resistance or stiffness.

In another variation, the resistance members include springs. The springs may be metal or plastic and may be arranged to provide tension and/or compression resistance. Where the springs comprise metal springs, the springs may be leaf springs, coil springs or torsion bars.

In a further variation, the springs include air-springs. Air springs may include gas-charged struts which provide resistance to compression in a predictable manner.

In a further variation, the air-spring may be in the form of an annular or toroid-shaped ring or doughnut of air surrounding the joint such that increasing the air pressure in the doughnut restricts the motion of the joint. This may take the place of the resistance members or be in addition to the resistance members, changing the quality of the motion.

In another variation, the balance chair further includes a seat-height adjuster attached between the seat and the flexible joint, wherein a height of a seat top above the flexible joint is selected according to a desired pivot action of the seat on the flexible joint. The seat-height adjuster may be executed in a number of ways, such as a threaded shaft (similar to a piano stool), a spring which may be arranged within the central post, or a gas strut, such as is commonly used in office chairs today. Raising the seat above the flexible joint by various amounts will affect the performance of the chair. A seat closely coupled to the flexible joint will exhibit the quick-pivoting ability of the short radius between the flexible joint and the seat. On the other hand, a seat raised significantly, or even moderately, above the flexible joint changes the chair's performance. The chair adjusted in this manner will exhibit longer movements and somewhat less abrupt pivoting tendencies, but may be a bit more unstable due to the height of the seat above the flexible joint.

In a further variation, the balance chair further includes a seat back attached to either the seat or the central post. Where the seat back is attached to the seat, the seat back may be less useful unless the seat and flexible joint are prevented from pivoting (see below). Where the seat back is attached to the central post, the seat back may be an aid to new users or a safety feature to prevent the user from reclining excessively or falling backward.

In another variation, the balance chair further includes chair arms attached to either the seat or the central post. Where the chair arms are attached to the seat, the chair arms back may be less useful unless the seat and flexible joint are prevented from pivoting (see below). Where the chair arms are attached to the central post, the chair arms may be an aid to new users or a safety feature to prevent the user from leaning excessively or falling sideways. The seat back and/or the arms may be attached to the central post either above or below the flexible joint so that they may move with the seat or remain stationary with respect to the central post. Different combinations are thus possible according to the user's preferences and the desired therapeutic effect.

In a further variation, the balance chair further includes a lock mechanism in communication with the flexible joint for the preventing any tilting movement of the seat. In this arrangement, when the lock mechanism is engaged, the balance chair behaves as a 'normal' chair. Such normalcy may be augmented by the seat back and chair arms described above.

From the foregoing, it may be appreciated that a need has arisen for a balance chair which has a flexible joint to permit a user to exercise and engage his/her core, and including resistance members to control the pivoting movement of the seat. Other features of the invention, and advantages over the prior art will become apparent from consideration of the following detailed description in conjunction with the provided drawings.

BRIEF DESCRIPTION OF DRAWINGS

For a more complete explanation of the present invention and the technical advantages thereof, reference is now made to the following description and the accompanying drawings in which.

BEST MODE FOR CARR NG OUT THE INVENTION

Embodiments of the present invention and their technical advantages may be better understood by referring to FIGS. 1-7D.

Figure 1:
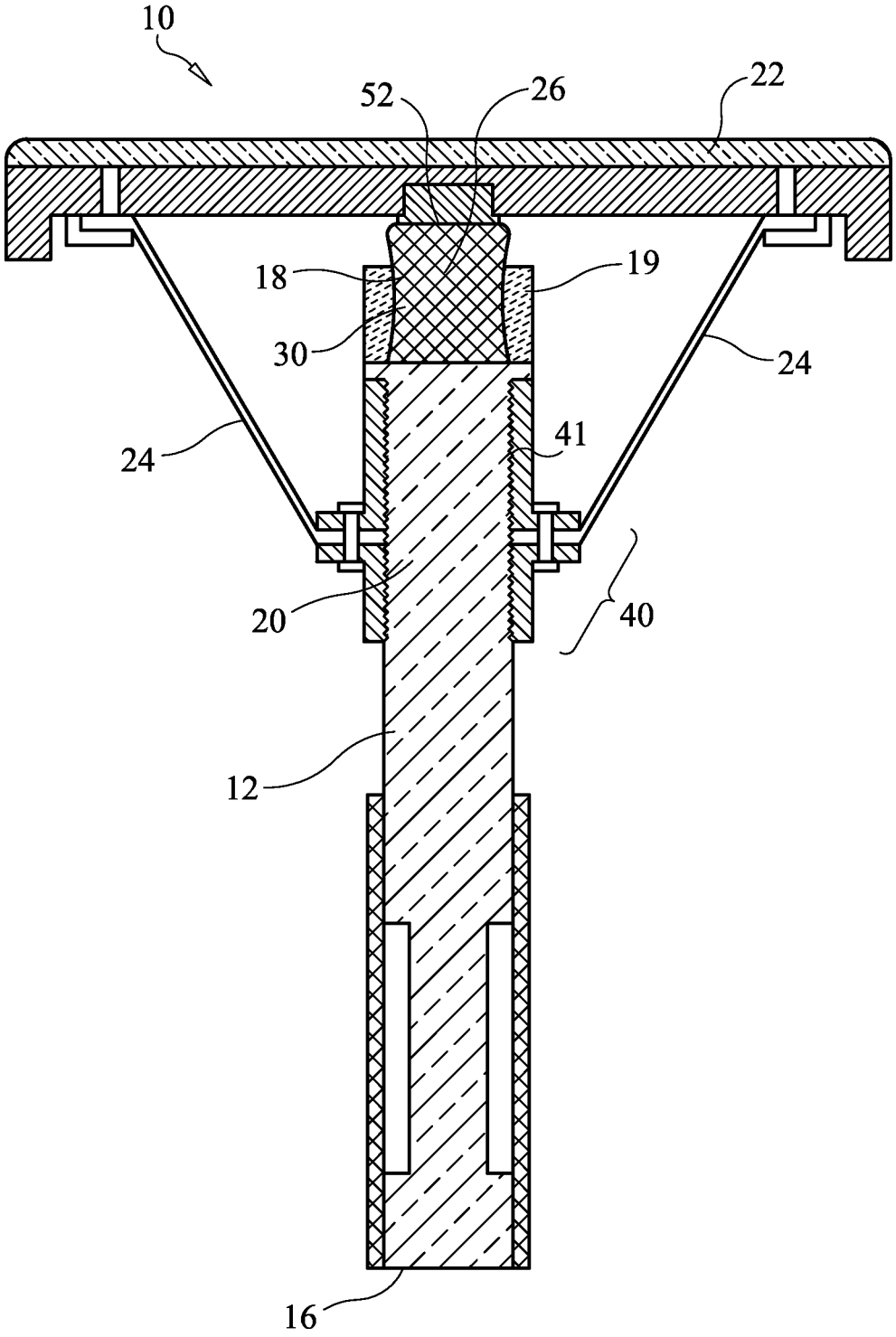
FIG. 1 illustrates a sectional side view of a balance chair according to an embodiment of the present invention.
Figure 2:
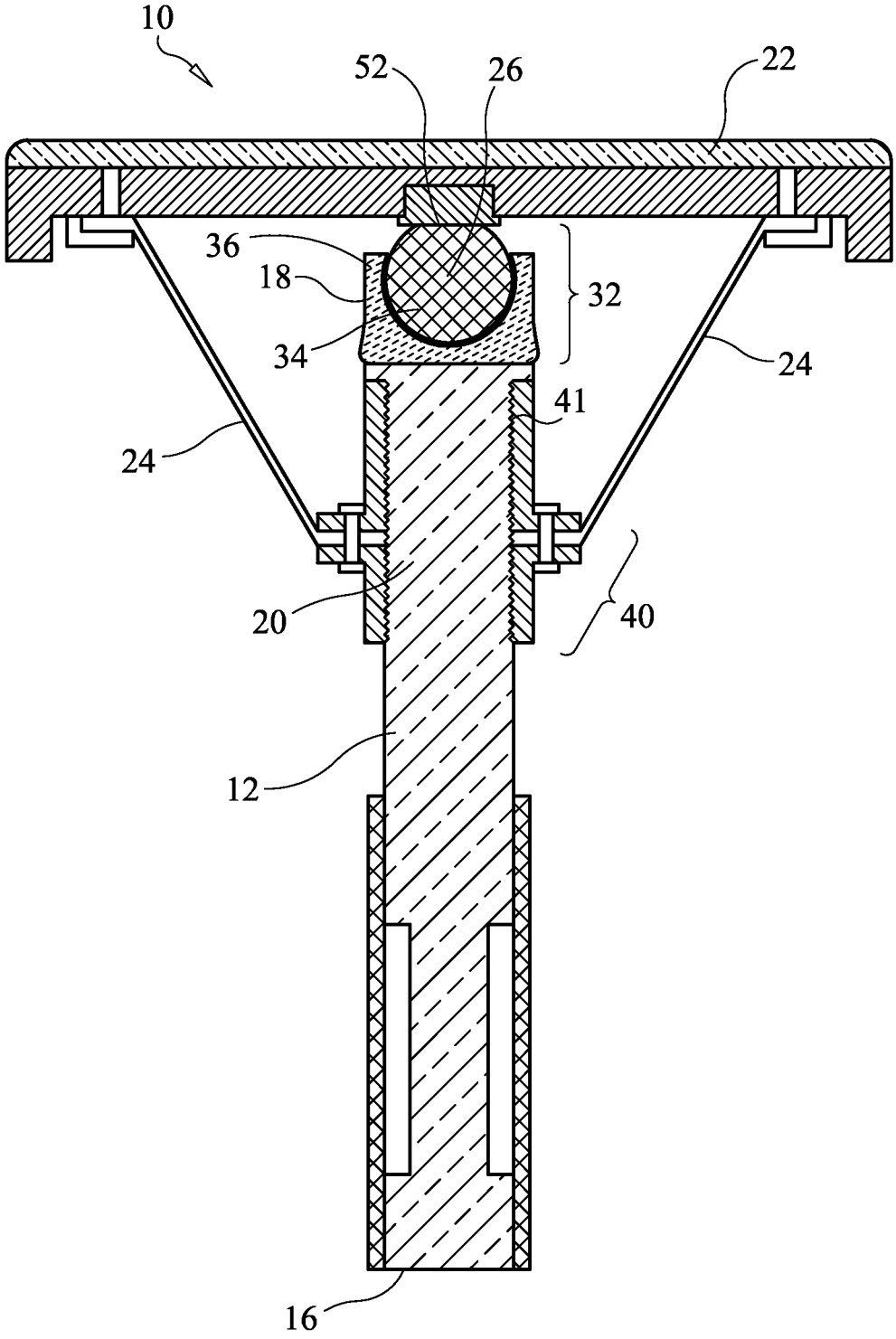
FIG. 2 illustrates a sectional side view of a balance chair according to an embodiment of the present invention.
Figure 3:
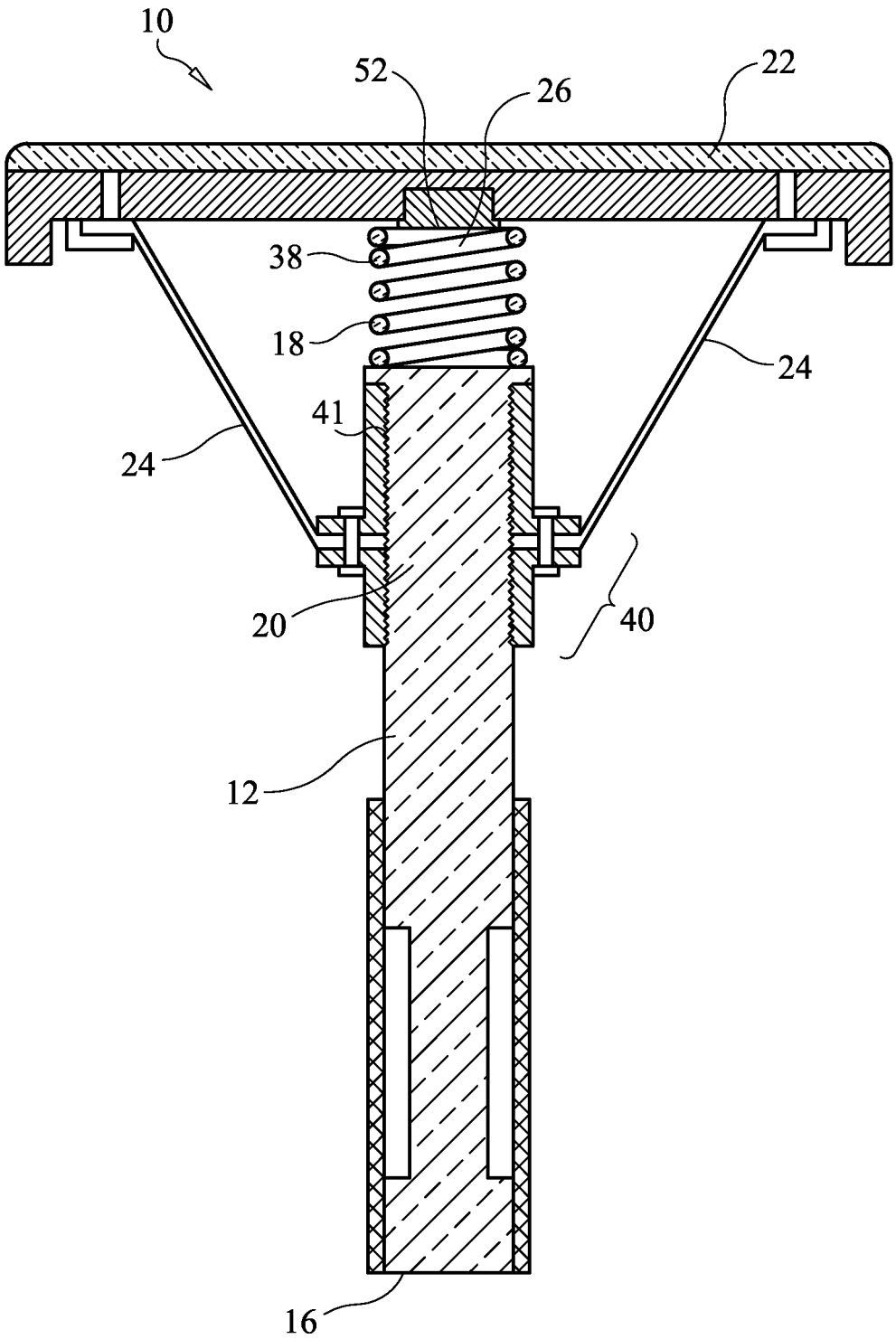
FIG. 3 illustrates a sectional side view of a balance chair according to an embodiment of the present invention.

Referring now to FIGS. 1-3, a balance chair 10 includes a central vertical post 12 with a base 14 attached at a lower end 16 of the central post 12; a flexible joint 18 attached at an upper end 20 of the central post 12; a seat 22 attached atop the flexible joint 18; and a plurality of resistance members 24 attached to the central post 12 and the seat 22, wherein the plurality of resistance members 24 are arranged around the central post 12 in a spaced-apart manner, wherein the flexible joint 18 supports the seat 22 and enables the seat 22 to pivot about an effective pivot point 26 defined by the flexible joint 18, and wherein the resistance members 24 resist but do not prevent pivoting of the seat 22 about the effective pivot point 26. The flexible joint 18 and the resistance members 24 co-act to support pivoting of the seat 22 both side-to-side and fore- and aft and any combination thereof. The resistance members 24 may limit a degree and/or quickness of pivoting of the seat 22. As a point of clarity, the translational motion is defined herein as motion of a body, e.g., the flexible joint, in such a way that any line which is imagined rigidly attached to the body remains parallel to its original direction. This is a shifting and partial collapse of the material of the flexible joint, which is not desirable.

A pivot-limiting arrangement including a lock mechanism 28 (see FIG. 4) may be placed in communication (e.g., a sliding connection) with the flexible joint 18, for the preventing any tilting movement of the seat 22, may be attached to the central post 12 for limiting a degree of pivoting of the seat 22. As illustrated in FIG. 4, the pivot-limiting arrangement 28 is a lock mechanism 28 which may be slid up (see arrows) the central post 12 to simultaneously engage the seat 22 and the central post 12, effectively limiting the movement of the seat 22 on the flexible joint 18.

As illustrated in FIG. 1, the flexible joint 18 may be an elastomer joint 30. As illustrated in FIG. 2, the flexible joint 18 may be a ball joint 32, including a ball 34 attached to the central post 12 and a socket 36 attached to the seat 22, although the relative positions of the ball 34 and socket 36 may be inverted, as desired. As illustrated in FIG. 3, the flexible joint may be a spring 38. Each of these variations brings its own set of advantages, according to user and manufacturing preferences.

Figure 4A:
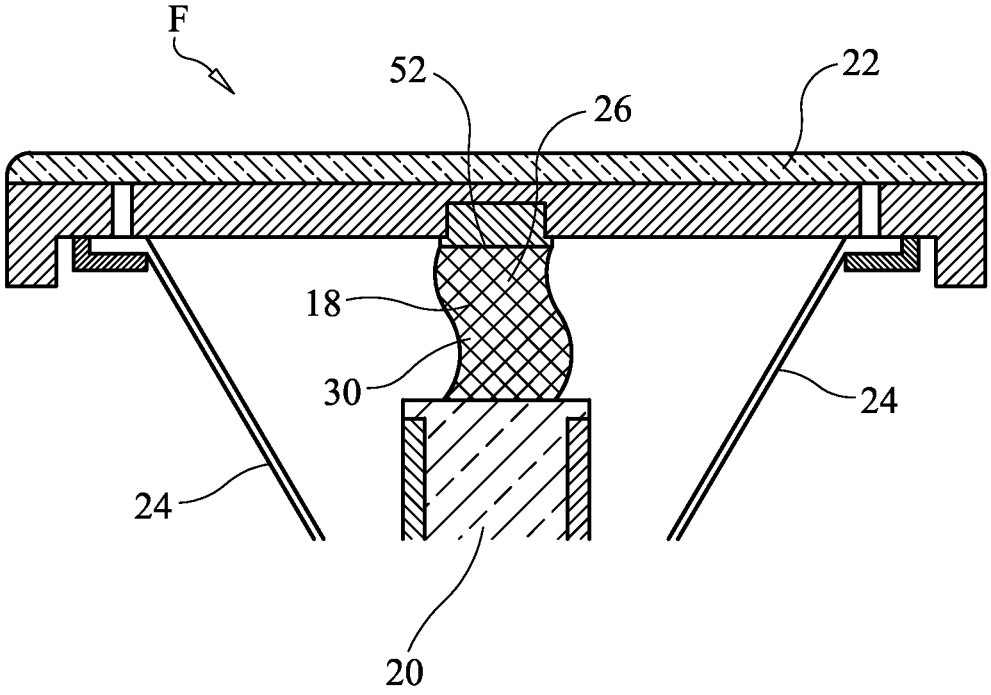
FIGS. 4A-4B illustrate exemplary side views of unsupported flexible joints.
Figure 4B:
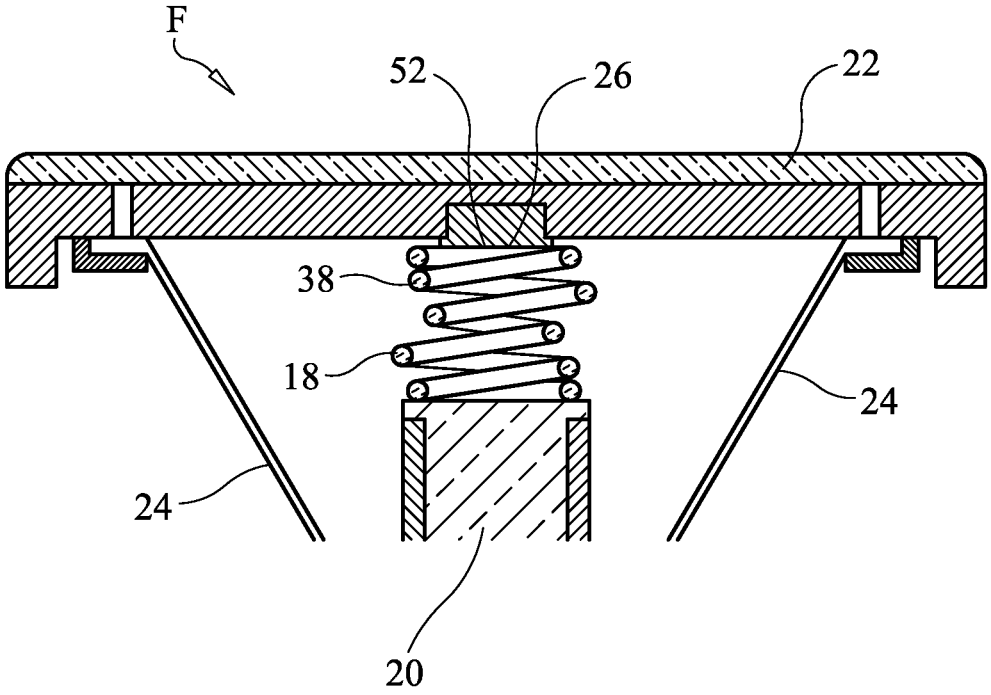
Figure 5A:
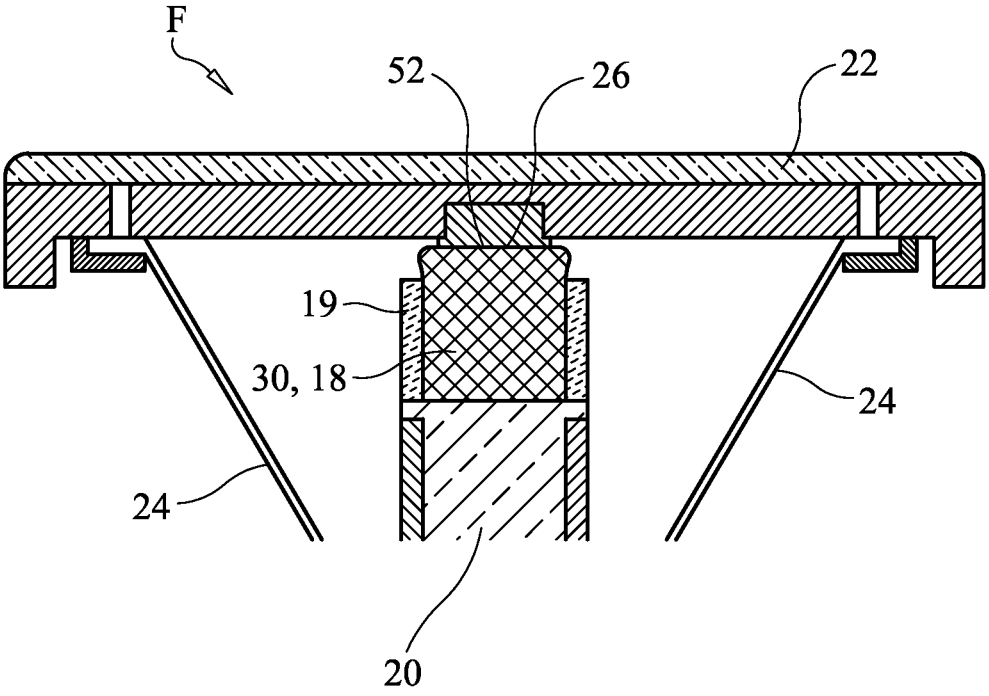
FIGS. 5A-5B illustrate exemplary side views of collar-supported flexible joints, according to an embodiment of the present invention.

A collar 19 may be included with the flexible joint 18, as illustrated in FIGS. 1 and 5A. The collar 19 may be in direct, supporting contact with the flexible joint 18, as shown in FIG. 1, for example. Alternatively, the collar 19 may be spaced apart from the flexible joint 18 by a predefined amount, depending on the type of flexible joint 18 and the desired therapeutic effect. The collar 19 provides supportive assistance to the flexible joint 18, such as an elastomeric joint 30 (FIG. 1), e.g., windsurfer mast joint, or a spring joint 38 (FIG. 3), especially where such flexible joints 18 may exhibit translational movement or partially- or fully-collapse under a vertical load. The translational movement is identified by a shifting of some or all of the material of the flexible joint 18, 30, 38 laterally, e.g. to one side or another, as illustrated in FIGS. 4A-4B.

FIGS. 4A-4B are identical except for the type of flexible joints employed. FIG. 4A illustrates an elastomer joint 30, while FIG. 4B illustrates a spring joint 38. Regardless, in some cases it is possible that, in response to a load F on the seat 22, the flexible joint 18, 30, 38 will exhibit translational movement. The load F may be considered to be the forces applied by the resistance members 24 and/or the weight of the person sitting on the chair. In these examples, the illustrated translational movement is to the right and/or left, but such movement may be in any direction and may be predictable due to the relatively balanced arrangement.

Figure 5B:
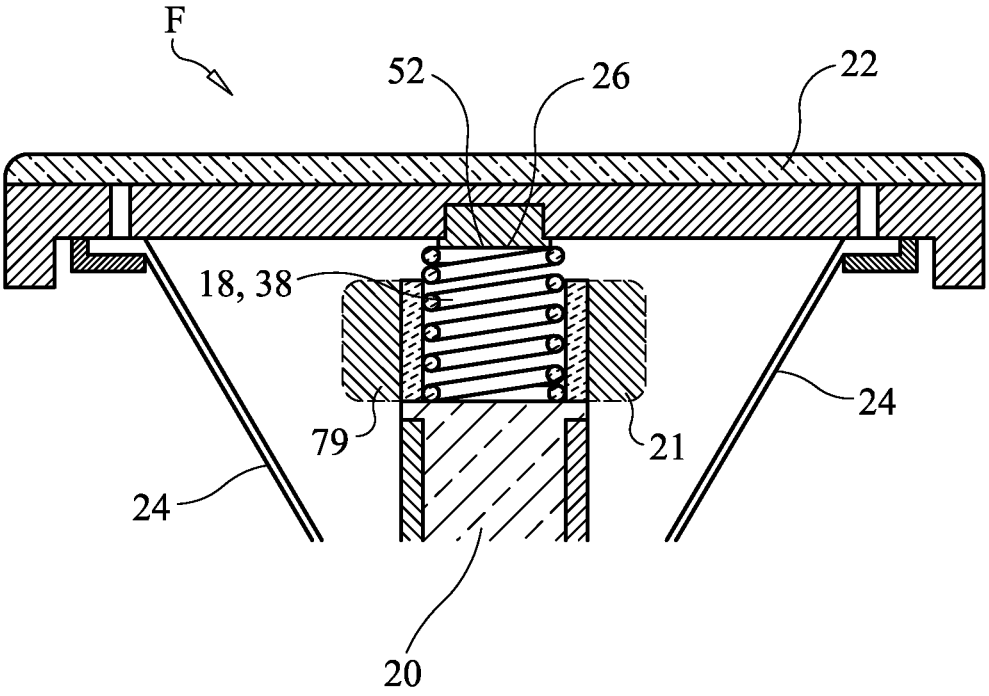
Figure 6:
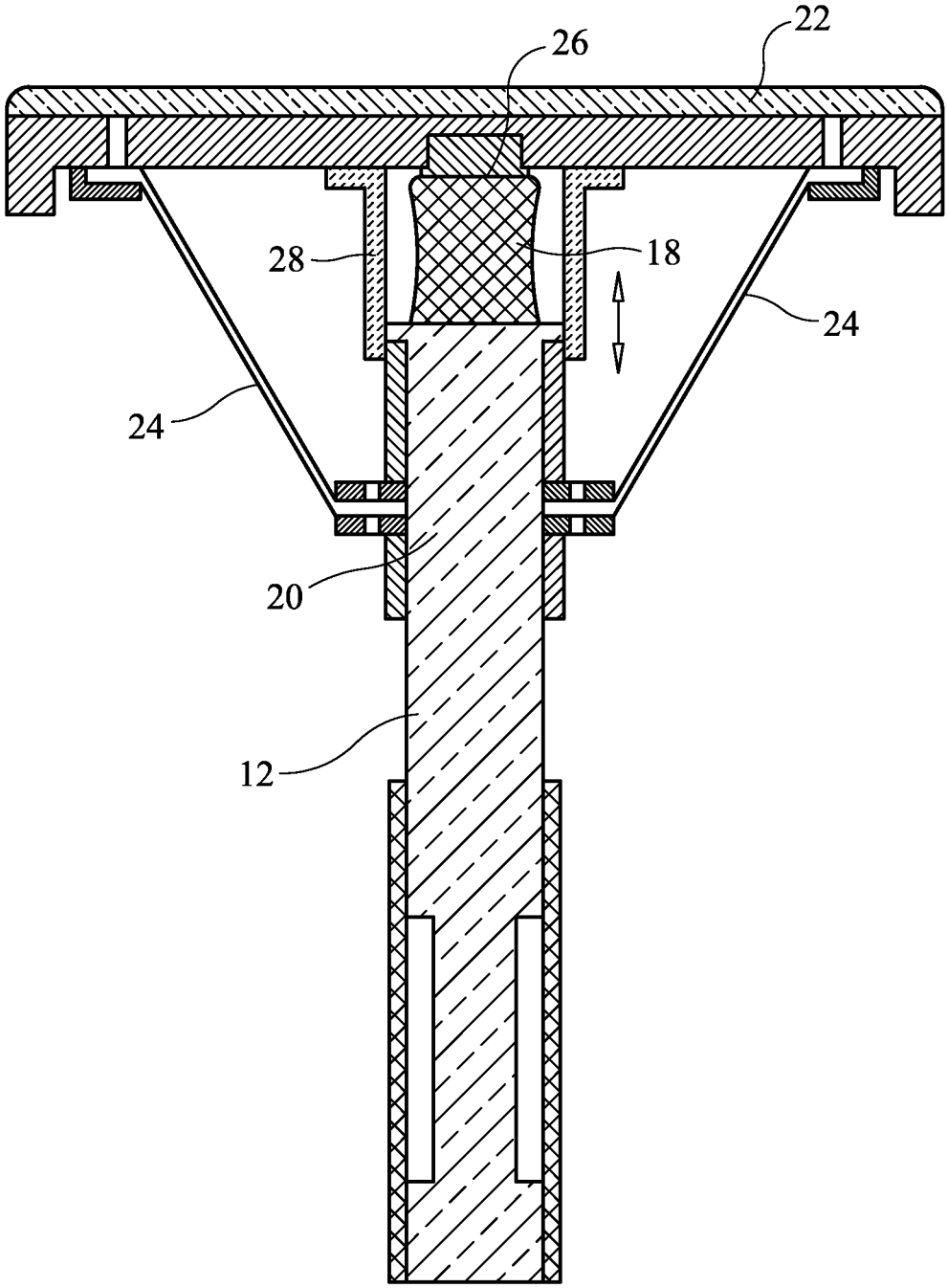
FIG. 6 illustrates a side view of the seat, flexible joint and resistance members of a balance chair according to an embodiment of the present invention.

Such translational movement reduces the ability of the flexible joint to provide supported omni-directional movement and tilting of the seat, and may act to reduce the life of the flexible joint. FIGS. 5A-5B illustrate the incorporation of a collar 19 to aid in supporting the flexible joint 18, 30, 38. The collar 19 may be fully integrated into the flexible joint 18, e.g. unitary molded construction, or the collar 19 may be a distinct element which is attached around the flexible joint 18, 30, 38. In other embodiments, the collar 18 may be adjustable, e.g. pneumatically, hydraulically or mechanically, according to manufacturing preferences and user requirements. FIGS. 5A-5B illustrate the exact same applied load F and flexible joint arrangements as in FIGS. 4A-4B, respectively, with the addition of the collar 19. The collar 19 supplies firm but flexible support to the flexible joint 18, 30, 38 so as not to limit the omni-directional movement range, but to limit or prevent the translational movement which unbalances the resistance members 24. As illustrated in FIGS. 5A-5B, the collar 19 does not envelop the entire flexible joint 18, 30, 38, but leaves the very top exposed. Such degree of coverage by the collar 19 may be adjusted to provide the desired effect. For example, a higher and/or thicker collar 19 may be used to provide a progressive resistance to movement, which would engage only after the seat 22 is tilted a predefined amount. In addition or alternatively, the collar 19 may provide a 'soft' stop, wherein movement of the seat 22 does not encounter a hard, abrupt limit when tilted, but provides a controlled or gradually-increasing resistance to movement culminating in a maximum degree of movement. As illustrated in FIG. 5B, the collar 19 may be a relatively thick arrangement 21, extending out from the flexible joint 18 to provide the additional support or the soft stop. The collar 19, 21 may be a solid material or a hydraulically- or pneumatically-adjustable unit, as desired.

An adjustment mount 40 may be attached to the central post 12 and to the resistance members 24, as illustrated in FIG. 1. According to the placement of the adjustment mount 40 on the central post 12, the resistance of the resistance members 24 is adjustable. For example, where the resistance members 24 apply tension, movement of the adjustment mount 40 downward on the central post 12 increases the tension of the resistance members 24. Alternatively, where the resistance members 24 apply a compression force, movement of the adjustment mount 40 downward on the central post 12 decreases the compressive force of the resistance members 24.

Figure 7A:
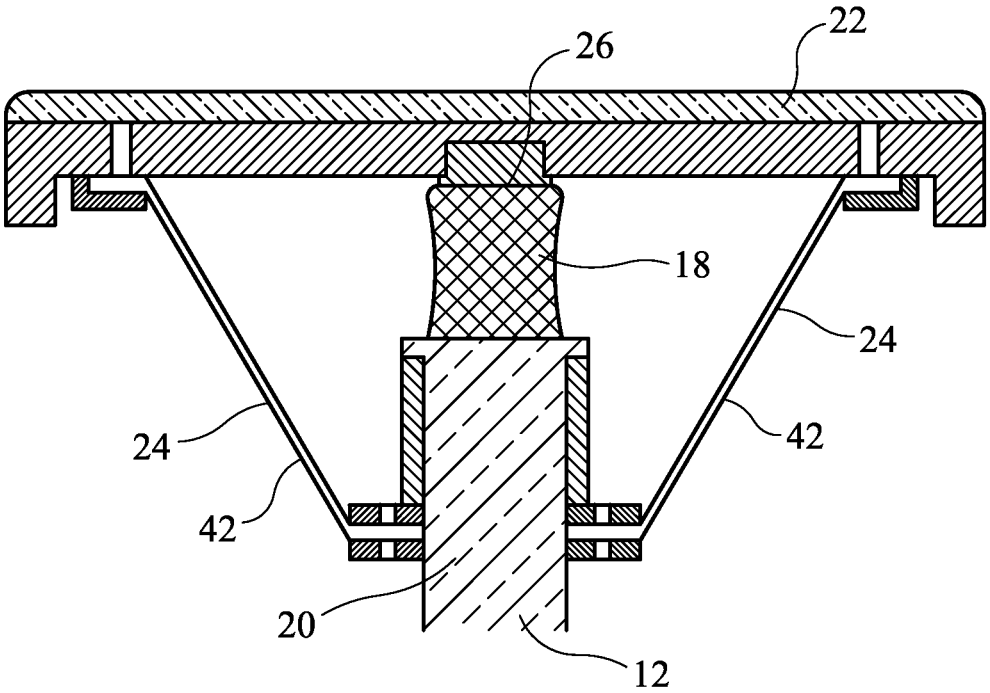
FIGS. 7A-7B illustrate a neutral position and a displaced position of a seat and tensioned resistance members according to an embodiment of the present invention.
Figure 7B:
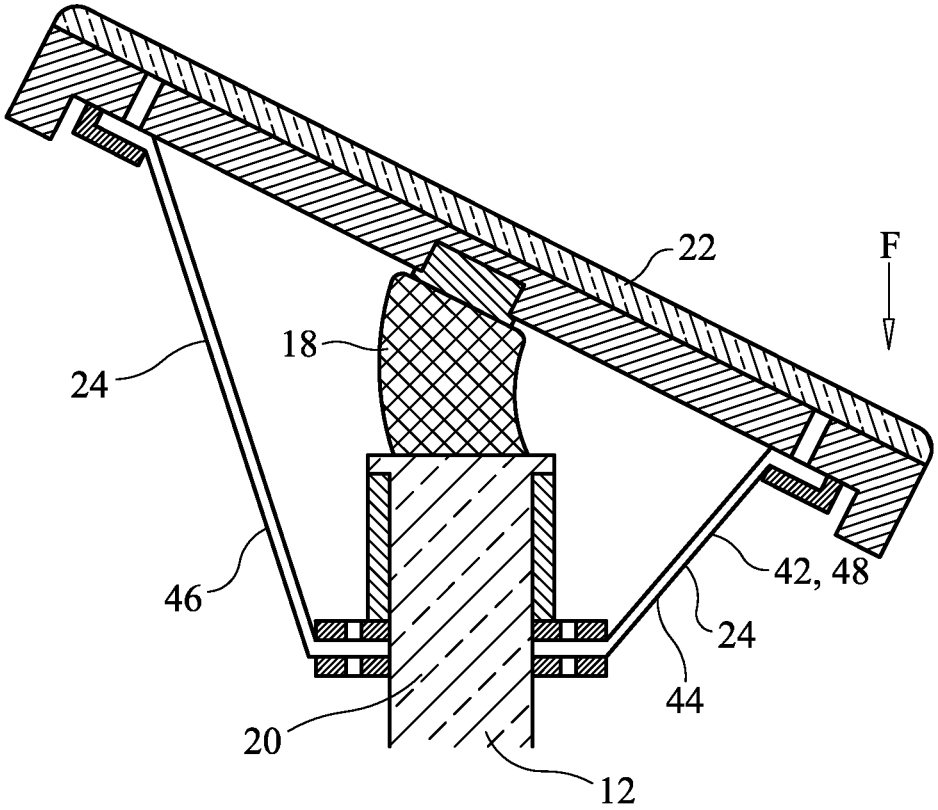

In one variation, such as illustrated in FIGS. 7A-7B, the resistance members 24 may be made of a polymer 42 or elastomer compound. Various polymer compounds may be used successfully, such as natural rubbers, synthetic rubbers, such as neoprenes (isoprenes), polypropylenes, urethanes, polyethylenes, and other polymer materials with similar characteristics. The exact dimensional arrangements and performance characteristics of each type of polymer or elastomer may be selected according to the desired performance characteristics of the balance chair. FIG. 7A illustrates a mutually-balanced condition for the polymer 42 resistance members 24, with the seat 22 in a level position. However, as illustrated in FIG. 7B, a downward force F applied off-center on the seat 22 will pivot the seat 22 downward toward that side, decreasing the tension 44 of the polymer 42 resistance members 24 at that side and increasing the tension 46 of the polymer 42 resistance members 24 on the opposite side. The flexible joint 18, in this case an elastomer joint 30, is deformed as well. Removal of the force F returns the seat to the level position (FIG. 7A) through equilibrium of the resistance members 24. The elastomer joint 30 returns to the neutral position of FIG. 7A as well.

Figure 8A:
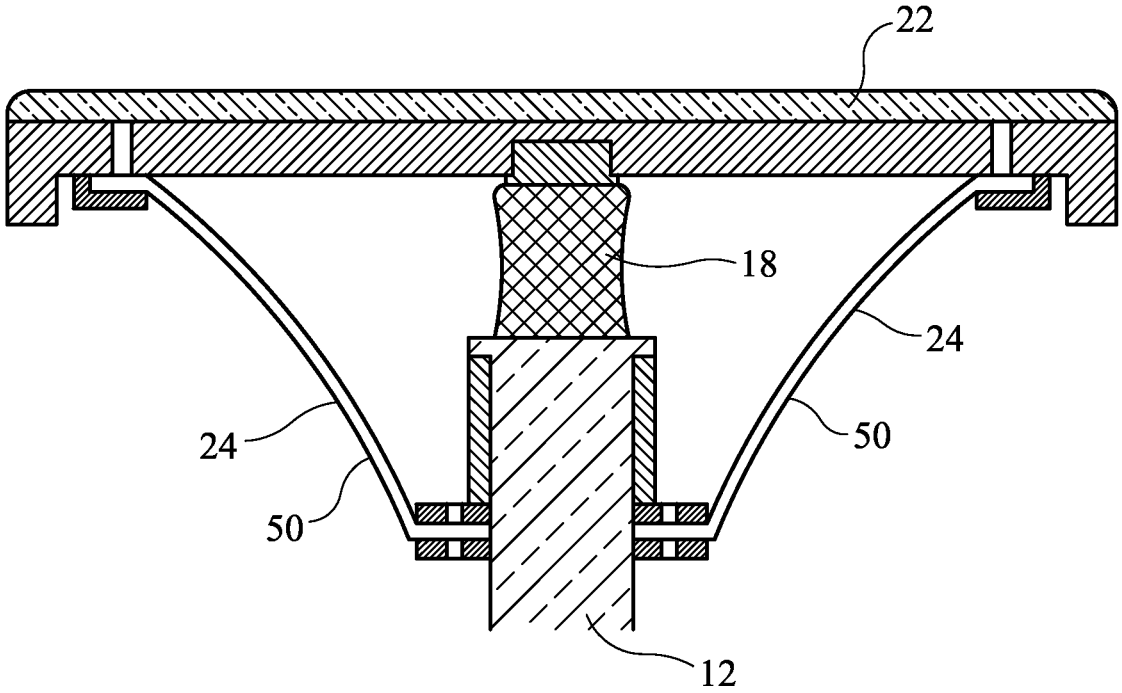
FIGS. 8A-8B illustrate a neutral position and a displaced position of a seat and compression resistance members according to an embodiment of the present invention.
Figure 8B:
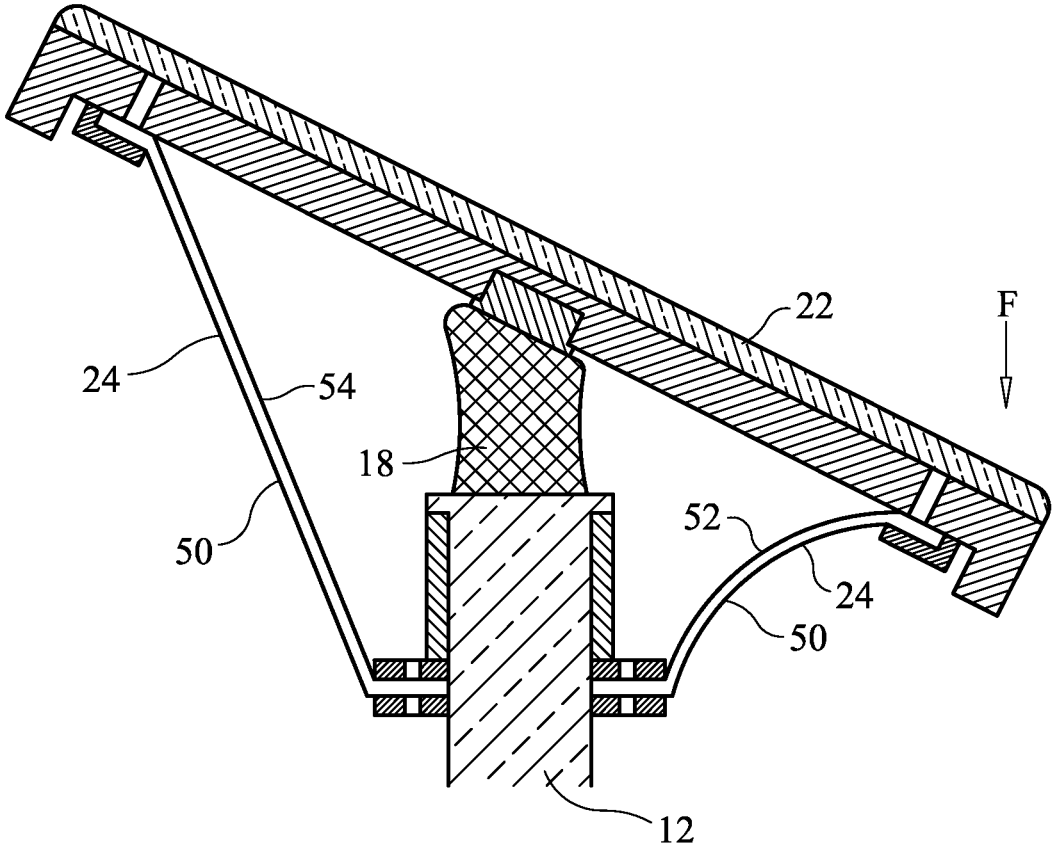

In another variation, the resistance members 24 may include springs 48. Where the springs 48 selected are to apply tension, their performance and arrangement within the balance seat 10 is according to FIGS. 7A-7B. However, the springs 48 may be selected to provide a compressive force. FIGS. 8A-8B illustrates a variation employing compressive springs 50.

FIG. 8A illustrates a mutually-balanced condition for the flexion spring 50 resistance members 24, e.g. leaf springs, with the seat 22 in a level position. However, as illustrated in FIG. 8B, a downward force F applied off-center on the seat 22 will pivot the seat 22 downward toward that side, increasing the compression 52 of the flexion spring 50 resistance members 24 at that side and decreasing the compression 54 of the flexion spring 50 resistance members 24 on the opposite side. Removal of the force F returns the seat to the level position (FIG. 8A) through equilibrium of the resistance members 24. Notice that, in FIG. 8B, the decreased compression 54 on the side opposite the force F effectively straightens the flexion spring 50 resistance members 24 on that side opposite the force F. If the flexion spring 50 resistance members 24 are incapable of being stretched, such as by reaching their mechanical limit, the fully-extended flexion spring 50 resistance members 24 also act as pivot-limiters.

Careful and particular selection of chair components and their dimensions enable the balance chair 10 to exhibit the desired degree of pivoting with the desired resistance to pivoting. The springs may be metal springs in a variety of configurations, such as leaf springs, coil springs and air springs.

Additional elements may be added to the balance chair to enhance its functionality. For example, the balance chair may further include a seat-height adjuster 52 attached between the seat 22 and the flexible joint 18, wherein a height of a seat top above the flexible joint 18 is selected according to a desired pivot action of the seat 22 on the flexible joint 18.

Figure 9A:
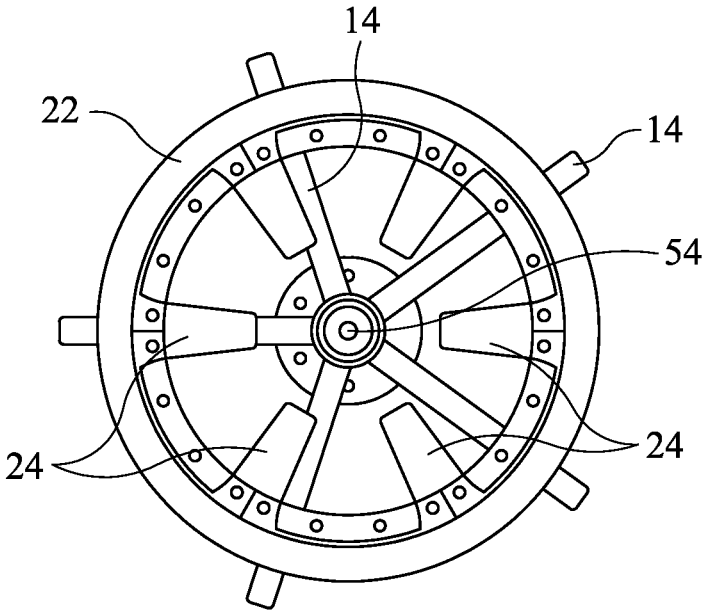
FIGS. 9A-9D illustrate top, perspective and profile views of various embodiments of the balance chair according to embodiments of the invention.
Figure 9B:
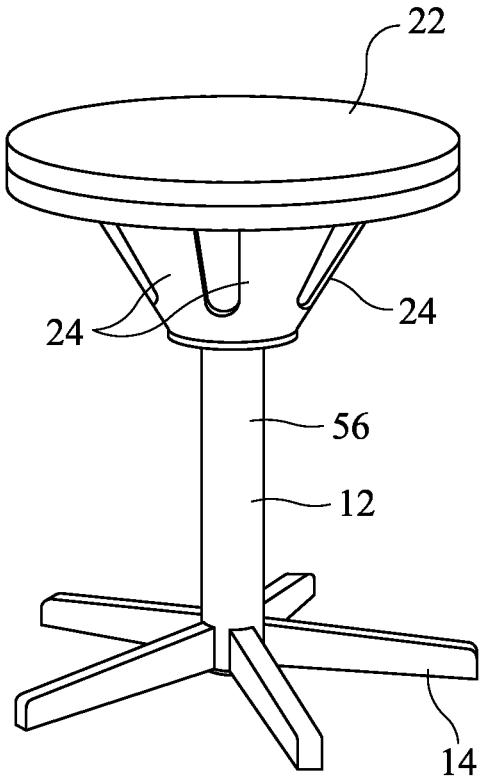
Figure 9C:
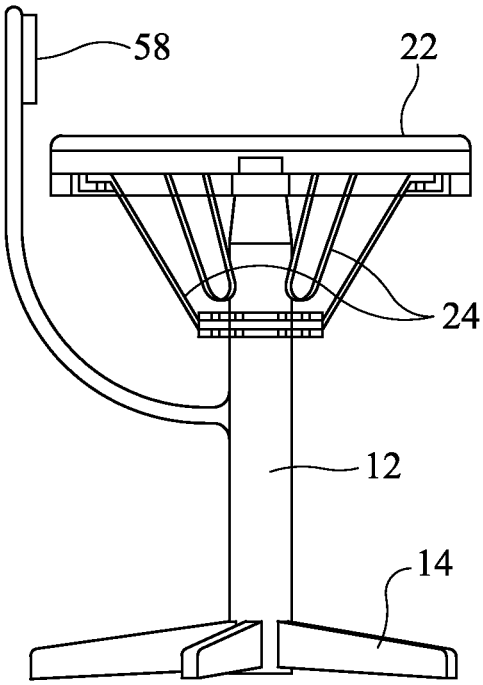

FIGS. 9A-9D illustrate various views and configurations of the balance chair 10 according to the present invention. FIG. 9A illustrates a top, ghost/transparent view of the balance chair 10 wherein the general concentricity of the elements is exhibited. The center post 12 may include an elevation control 54 to provide elevation adjustments of the seat 22 without affecting the relationship between the seat 22 and the flexible joint 18 and the effective pivot point 26. The elevation control 54 may be operated via a handle 56, illustrated in FIG. 9B.

Figure 9D:
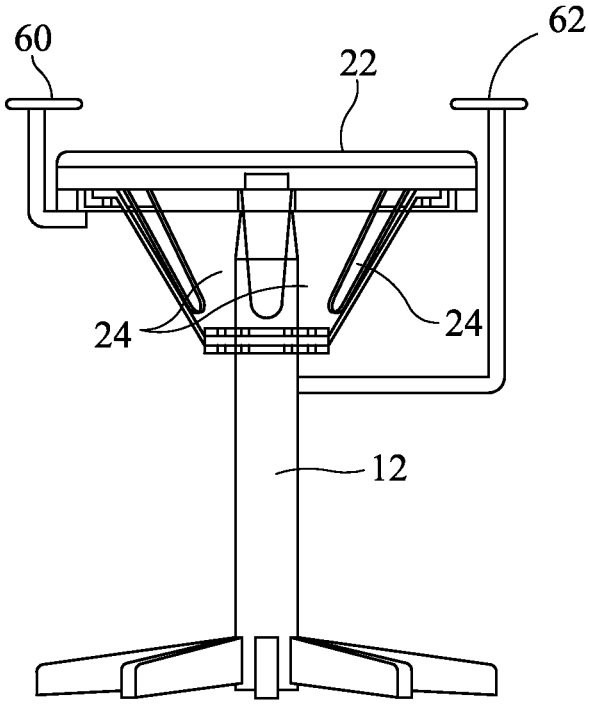

FIG. 9D illustrates that a seat back 58 may be attached to the seat 22 or the central post 12. In addition, chair arms 60, 62 may be attached to the seat 22 (arm 60) or to the central post 12 (arm 62).

A balance seat 10 as described in the foregoing solves all of the problems mentioned in the introduction. Finally, the large range of motion and ease of motion allowed by this mechanism enables one to keeps one's joints from getting stiff. Additionally, many design variations and alterations are possible which would change product appearance, increase or decrease its resistance, and enable one chair to fit many sizes of user.

What is claimed is:

1. A balance chair comprising a central vertical post with a base attached at a lower end of the central post;

a flexible joint attached at an upper end of the central post;

a seat attached atop the flexible joint;

a plurality of resistance members attached to the central post and the seat, wherein the plurality of resistance members are arranged around the post in a spaced-apart manner, wherein the flexible joint supports the seat and enables the seat to pivot omni-directionally about an effective pivot point defined by the flexible joint, and wherein the resistance members resist but do not prevent pivoting of the seat about the effective pivot point; and a seat-height adjuster attached between the seat and the flexible joint, wherein a height of a seat top above the flexible joint is selected according to a desired pivot action of the seat on the flexible joint.

2. The balance chair of claim 1, wherein the flexible joint permits pivoting of the seat omni-directionally, to include both side-to-side, fore-and aft and any combination thereof.

3. The balance chair of claim 1, wherein the resistance members limit a degree of pivoting of the seat.

4. The balance chair of claim 1, wherein the collar is in direct supporting contact with the flexible joint.

5. The balance chair of claim 1, further comprising a pivot-limiting arrangement attached to the central post for limiting a degree of pivoting of the seat.

6. The balance chair of claim 1, further comprising an adjustment mount attached to the central post, wherein resistance of the resistance members is adjustable according to placement of the adjustment mount.

7. The balance chair of claim 1, wherein the flexible joint is an elastomer joint.

8. The balance chair of claim 1, wherein the flexible joint is a ball joint.

9. The balance chair of claim 1, wherein the flexible joint is a spring.

10. The balance chair of claim 1, wherein the resistance members are made of a polymer compound.

11. The balance chair of claim 1, wherein the resistance members comprise springs.

12. The balance chair of claim 11, wherein the springs comprise metal springs.

13. The balance chair of claim 11, wherein the springs comprise leaf springs.

14. The balance chair of claim 1, wherein the springs comprise air-springs.

15. The balance chair of claim 1, further comprising a seat back attached to one of the seat and the central post.

16. The balance chair of claim 1, further comprising chair arms attached to one of the seat and the central post.

17. The balance chair of claim 1, further comprising a lock mechanism in communication with the flexible joint for the preventing any tilting movement of the seat.

* * * * *